United States Patent [19]

Ward

[11] Patent Number: 4,911,492

[45] Date of Patent: Mar. 27, 1990

[54] APPARATUS FOR REMOVAL OF FOREIGN MATERIAL FROM SINK DISPOSAL UNITS

[76] Inventor: John L. Ward, 1006 Barnwell St., Columbia, S.C. 29201

[21] Appl. No.: 324,176

[22] Filed: Mar. 16, 1989

[51] Int. Cl.[4] ..... B25B 7/00; F21V 33/00

[52] U.S. Cl. ..... 294/118; 294/1.1; 362/253

[58] Field of Search ..... 294/66.2, 118, 1.1; 15/104.31, 104.32; 362/109, 253; 241/301

[56] References Cited

U.S. PATENT DOCUMENTS

| | | | |
|---|---|---|---|
| 893,029 | 7/1908 | Spannagel | 240/119 |
| 1,457,198 | 5/1923 | Utley | 15/104.32 X |
| 1,676,434 | 7/1928 | Furneaux | 81/485 |
| 2,208,883 | 7/1940 | Hall | 240/6.46 |
| 2,355,086 | 8/1944 | Lang | 294/66.2 |
| 3,163,371 | 12/1964 | Hardy | 241/100.5 |
| 3,590,235 | 6/1971 | Leo | 240/6.46 |
| 3,924,115 | 12/1975 | Hampton et al. | 362/109 X |
| 4,073,533 | 2/1978 | Debrey et al. | 294/118 |
| 4,312,530 | 1/1982 | Young | 294/118 |
| 4,480,295 | 10/1984 | Shuster | 362/206 |
| 4,619,248 | 10/1986 | Walsh | 128/18 |

*Primary Examiner*—Russell D. Stormer
*Attorney, Agent, or Firm*—Dority & Manning

[57] ABSTRACT

An annular member received in a disposal unit displaces rubber guard members covering the sink opening while establishing an unobstructed central passageway in communication with the grinding hopper of the disposal unit. Lights supported on a lower portion of the annular member illuminate the interior of the disposal unit, which interior is accessed through the annular member central passageway by elongated and slenderized tongs for grasping and removing undesired foreign matter within the disposal unit.

15 Claims, 2 Drawing Sheets

APPARATUS FOR REMOVAL OF FOREIGN MATERIAL FROM SINK DISPOSAL UNITS

BACKGROUND OF THE INVENTION

The present invention relates generally to improved sink disposal unit maintenance, and more specifically to an apparatus for insertion into a sink opening and disposal unit mouth to aid in the removal of undesired foreign matter therefrom.

Sink disposal units have been commonly used in kitchen sinks in homes, restaurants, and the like for elimination of small amounts of waste, generally food or garbage items. The disposal unit is typically mounted beneath the sink basin (or drain opening), and includes a hopper which receives all matter passed thereto through the sink opening. A sink flange is often disposed about the sink opening. Liquids and solid matter (preferably ground by the disposal unit) freely flow from the hopper into outlet plumbing leading away from the sink by virtue of small drainage apertures in the disposal unit hopper. Larger solid particles, however, are prevented from passing into the outlet plumbing by virtue of the relatively small dimensions of the drainage apertures. It is generally undesirable for such larger particulate matter to enter the plumbing system, as well understood by those of ordinary skill in the art.

Grinding blades are situated within the hopper for reducing the larger waste matter thereinto a finer size, preferably small enough to fit through the drainage apertures without clogging the disposal unit or the plumbing. The blades are generally electrically rotated within the unit as water is flushed through the sink to carry disintegrated or ground waste particles through the drainage apertures. A flexible splash guard is usually disposed just below the sink opening at the mouth of the hopper to prevent splashing while the disposal unit operates, and to prevent the inadvertent introduction of objects into the hopper. Further exemplary discussion of the construction and operation of conventional disposal units and splash guards may be found in U.S. Pat. No. 3,163,371, issued to Hardy, the disclosure of which is incorporated herein by reference.

Even though sink disposal units are generally provided with a flexible splash guard, it is still not uncommon for an object requiring immediate removal (rather than flushing) to inadvertently enter the disposal unit. A foreign object (such as a drink can tab, cutlery, jewelry, etc.) made of metal or plastic could damage the disposal unit if the unit were to be run while the foreign matter is within the hopper. To prevent damage to the disposal unit or to the object, the foreign object must be removed.

It is undesirable and dangerous to have to feel around by hand beneath the splash guard inside of a wet, dirty disposal unit hopper to retrieve the foreign matter. It is also difficult to get a clear view of the hopper due to the splash guard blocking direct visual access to the hopper. Resiliency of the splashguard also impedes removal of the foreign object, whether by hand or with use of a retrieval instrument or tool of some type. Furthermore, if the foreign matter were in the hopper while the unit were running, the foreign matter may be ground into numerous pieces or may become tightly lodged in the unit, thereby making removal even more difficult.

SUMMARY OF THE INVENTION

The present invention recognizes and addresses such drawbacks and other aspects of sink disposal unit foreign matter removal. Accordingly, one object of the present invention is to provide an apparatus for conveniently and safely removing foreign matter from a sink disposal unit.

A further object of the present invention is to provide a device for insertion into a sink opening which displaces the splash guard associated with the disposal unit and establishes an unobstructed passageway to allow improved access to and viewability of the disposal unit hopper, for facilitating the removal of foreign matter therefrom.

A still further object of the present invention is to provide a device such as the foregoing for insertion into a sink opening which also illuminates the disposal unit hopper, to even further facilitate the removal of foreign matter therefrom.

Another object of the present invention is to provide a device for insertion into a sink opening and including specialized means for entering the hopper through an established unobstructed passageway, to grasp and remove foreign matter from the hopper of a sink disposal unit.

These and other objects, aspects, and features of this invention are more particularly discussed and described in the remainder of the specification. Also, differing embodiments of this invention may be provided as differing combinations of presently disclosed features. One present exemplary embodiment is directed to a device to aid in removal of foreign matter from a sink garbage disposal unit of the type having an interior refuse hopper and an elastomeric guard means adjacent an opening to such hopper. Such device preferably includes annular insertion means for insertion into the hopper opening, with the outer circumference of such annular insertion means providing access to the hopper by deflecting the elastomeric guard means so as to clear a pathway to such hopper. Also, the annular insertion means preferably defines an interior passageway therethrough which permits communication with the hopper. The device may further include light means, mounted on the annular insertion means for illuminating the hopper, whereby improved access to and visibility of the hopper are provided so that foreign matter may readily be grasped and removed therefrom through the annular insertion means passageway.

Another exemplary embodiment concerns an apparatus for removal of foreign matter from a sink disposal unit of the type having a hopper disposed within the disposal unit for receiving waste material and a flexible splash guard disposed adjacent an opening to such hopper. Such an apparatus may comprise a thin-walled annular member having a central passageway, a light source, and grasping means. The annular member is for insertion into the hopper opening so as to provide access to the hopper through the central passageway. The annular member may further include a lower portion for extending into the hopper opening to displace the flexible splash guard. The light source is supported on the lower portion of the annular member for illuminating the hopper whenever the annular member is inserted into the hopper opening. The grasping means is for insertion through the annular means central passageway for grasping and removing foreign matter from the hopper.

Still another exemplary construction in accordance with this invention relates to a device comprised of a thin-walled annular member and grasping means. The annular member has a central passageway, and serves for insertion into the sink opening and the disposal unit mouth for providing access to the hopper through the central passageway thereof. The annular member also includes an upper portion defining an upper outer diameter larger than the sink opening, a lower portion defining a lower outer diameter smaller than the sink opening for extending into the sink opening and displacing the splash guard, and further includes electrical supply means, and a light source. The annular member yet further includes a chamfered surface on the outside diameter thereof and disposed between the upper and lower portions thereof for seating the annular member in the sink drain opening, with the light source including at least one light bulb disposed on the lower portion of the annular member for illuminating the hopper, and the electrical supply means including an electrical cord operatively interconnected with the light bulb.

In the foregoing combination of annular member and grasping means, the grasping means may serve for insertion through the annular member central passageway, and may comprise tongs defining two long, slender bars which are pivotably joined, such bars including opposable teeth for securely grasping foreign matter, to facilitate removal of such foreign matter from the hopper.

Various modifications and alterations to the features, elements, and constructions disclosed herewith may occur to those of ordinary skill in the art, and are intended to come within the spirit and scope of this invention by virtue of present reference thereto. Such modifications and variations may include, but are not limited to, the substitution of functionally equivalent structures and elements for those expressly disclosed, illustrated, or suggested herewith, as well as the interchange of various features and elements (e.g., reversal of parts) presently disclosed.

BRIEF DESCRIPTION OF THE DRAWINGS

A full and enabling disclosure of the present invention, including the best mode thereof, to one of ordinary skill in the art is set forth more particularly in the remainder of this specification, including reference to the accompanying figures, in which.

Figure 1:
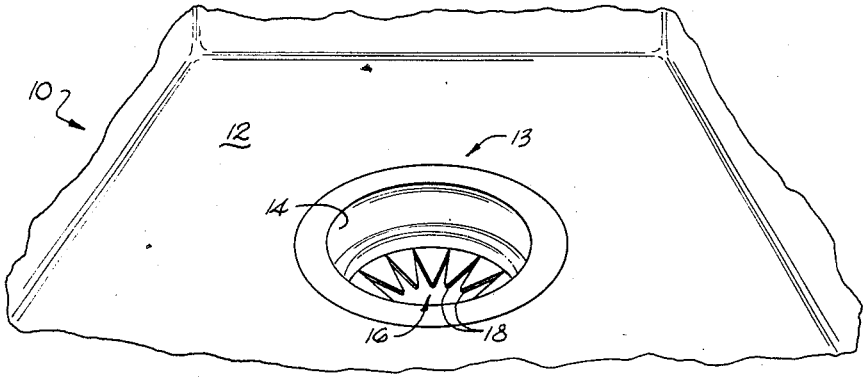
FIG. 1 illustrates a perspective view of a conventional sink showing a sink drain opening and a disposal unit splash guard mounted just beneath such opening.

Repeat use of reference characters in the following specification and appended drawings is intended to represent the same or analogous features or elements of the present invention.

DETAILED DESCRIPTION OF AN EXEMPLARY PREFERRED EMBODIMENT

Figure 2:
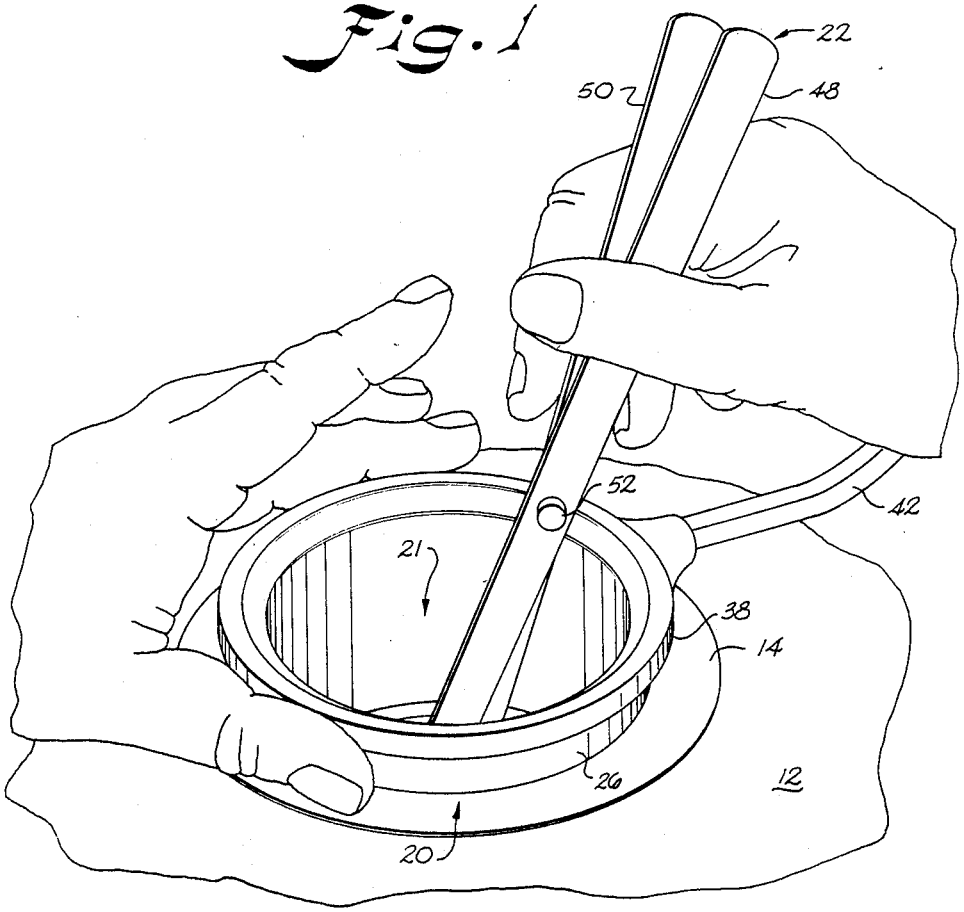
FIG. 2 illustrates a perspective view of an exemplary device in use in accordance with the present invention, showing such device disposed within a sink opening such as of FIG. 1.
Figure 3:
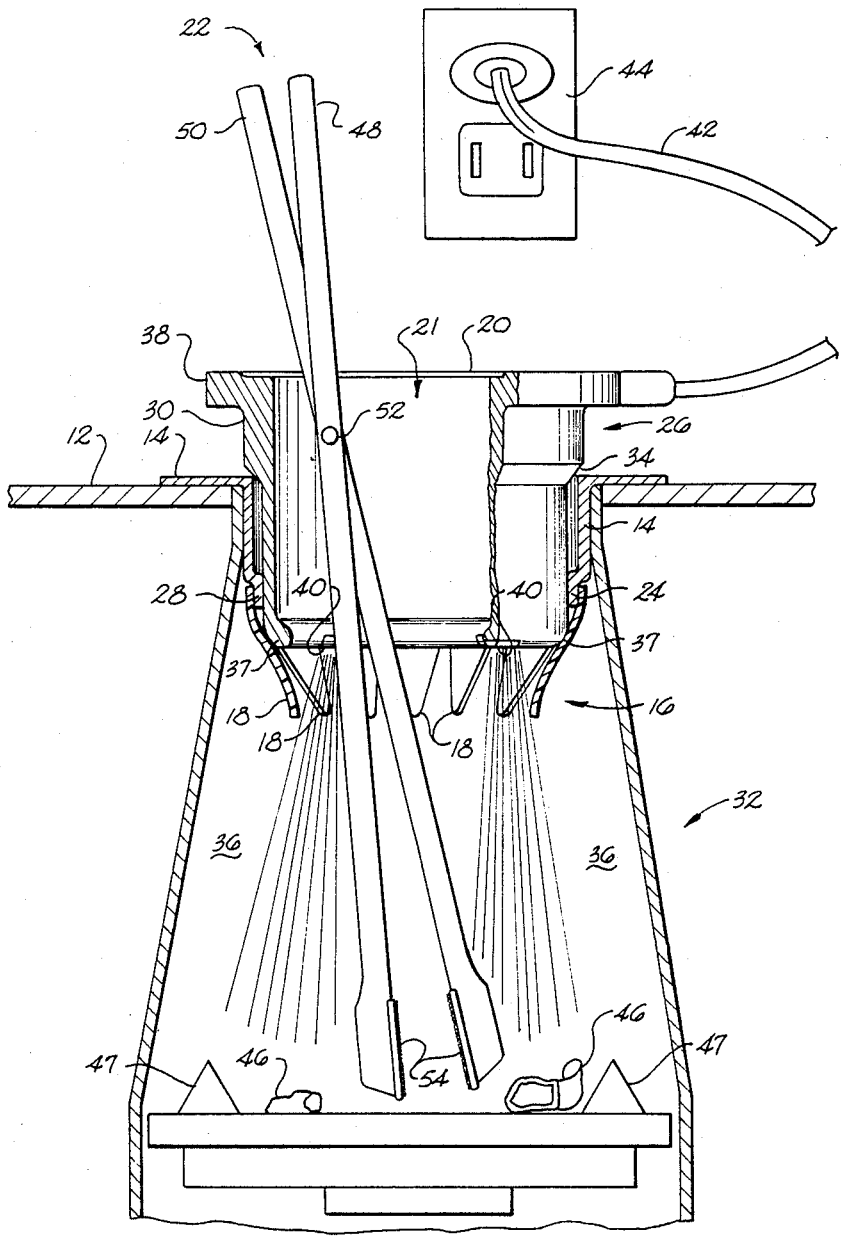
FIG. 3 illustrates a mixed side cross-sectional and partial view of an exemplary device in accordance with the present invention, with such device received in a sink opening and disposal unit hopper, and radially outwardly deflecting the flexible splash guard thereof.

Referring now to the drawings in detail, there is shown in FIG. 1 typical sink 10 including a basin 12 and sink drain opening 13 defined by a sink flange 14. A splash guard 16 includes a plurality of resilient flexible members or leaves 18, which may be supported on either sink flange 14, or on part of a sink disposal unit. FIGS. 2 and 3 represent use of the present invention in relation to sink drain opening 13.

The present invention preferably includes a relatively thin-walled annular member or annular insertion means 20 (generally rigid) for insertion into the sink opening 13. Grasping means 22 may be positioned through a central passageway 21 formed by member 20, as illustrated. Annular member 20 defines both a lower portion 24 and an upper portion 26. Lower portion 24 of annular member 20 is intended for insertion into sink opening 13 and accordingly preferably defines a lower outer diameter 28 small enough to fit inside of the diameter of sink flange 14. Outer diameter 30 of upper portion 26 is preferably greater than outer diameter 28 of lower portion 24, and is also preferably greater than the diameter of sink flange 14.

FIG. 3 shows that a resulting chamfered surface 34 is preferably disposed generally between upper portion 26 and lower portion 24. When inserted into sink opening 13, chamfered surface 34 of annular member 20 seats against sink flange 14, thereby preventing annular member 20 from completely sliding into hopper 36 of sink disposal unit 32. The relative width of angled annular chamfered surface 34 allows for the placement of annular member 20 into sink openings of various diameters (limited to a range of diameters falling between lower outer diameter 28 and upper outer diameter 30), while still being securely seated in opening 13 against sink flange 14.

In fulfillment of one of the main present objects, when annular member or annular insertion means 20 is inserted into sink flange 14, it simultaneously contacts and spreads radially outward the flexible members 18 of splash guard 16 from their respective positions shown in FIG. 1 to their respective positions shown in FIG. 3. Such deflection takes place as a curved, annular engagement surface 37 of lower portion 24 is urged downward against the splash guard members. It can be readily seen that greater access to hopper 36 is facilitated because annular member 20 spreads apart the splash guard members, while leaving unobstructed the central passageway 21.

An annular lip 38 of various shapes and/or sizes may be provided about upper portion 26 of annular member 20 to facilitate manipulation of the present invention during use (such as demonstrated in FIG. 2). It is desirable, but not required, that annular lip 38 be axially displaced from chamfered surface 34 for ease of such manipulation. Alternatively, if sink opening 13 is relatively large enough (that is, larger than even upper outer diameter 30), annular insertion means 20 may be seated in opening 13 against annular lip 38 thereof, rather than against its chamfered surface 34. The axial length of annular insertion means 20 may be varied as desired for proper operation with various disposal units, or in other uses of the invention.

Supported on annular member 20 (preferably on lower portion 24 thereof) is a light source or means 40, including at least one bulb (not seen due to the preferred recessed position thereof) for illuminating hopper 36. Light source 40 is operatively connected within the structure of annular member 20 by electrical wires comprising electrical supply means (not shown), including for example an electrical power cord 42 which may be plugged into a standard electrical outlet 44 or attached to any other suitable power source. Light source 40 facilitates the identification and subsequent removal of foreign matter 46 from hopper 36. One light bulb, or two spaced light bulbs (or even more) may be used. Different types of light sources, even battery or fluorescent driven or the like, may be used, and variously supported in accordance with this invention. Also, light source 40 may be relatively moved about by manipulating annular lip 38 so as to rotate annular member 20 within sink flange 14, thereby altering the illumination of desired portions of hopper 36. Such rotation or movement technique may be particularly useful if the beam pathway of light source 40 is somewhat angled.

Grasping means 22 of the present invention may assume various forms, but preferably comprises a pair of specialized tongs including two long slender bars 48 and 50 rotatably or pivotably joined by a rivet 52 or other equivalently-functioning member. As is shown in both FIGS. 2 and 3, the grasping means are placed through the central passageway 21 of annular member 20 for retrieving foreign matter 46 from hopper 36. Opposable teeth 54 disposed at a grasping end of such tongs make it easier to securely grasp and retrieve foreign matter 46 from within hopper 36, even when lodged near the bottom of hopper 36 adjacent teeth 47 of the disposal unit 32. The relatively central location of the pivot point on tongs 22 contributes to desired slenderizing of the grasping means structure.

As will be appreciated by those of ordinary skill in the art from the foregoing specification, various embodiments of the present invention may be directed to environments and uses other than those illustrated in present FIGS. 2 and 3. Moreover, it will be understood by those of ordinary skill in the art that the foregoing specification and drawings discussed with reference thereto are only exemplary embodiments of the present invention, with all such language being by way of example and illustration only, rather than language of limitation. Also, individual features and aspects of the foregoing exemplary embodiments may be varied for accommodating alternative practicing of the present invention, all without departing from the spirit and scope of the present invention set forth in the appended claims.

What is claimed is:

1. A device to aid in removal of foreign matter from a sink garbage disposal unit of the type having an interior refuse hopper and an elastomeric guard means adjacent an opening to such hopper, said device including annular insertion means for insertion into the hopper opening, with the outer circumference of said annular insertion means providing access to the hopper by deflecting said elastomeric guard means so a to clear a pathway to such hopper, said annular insertion means also defining an interior passageway therethrough which permits communication with such hopper, and said device further including light means, mounted on said annular insertion means for illuminating the hopper, whereby improved access to and visibility of the hopper are provided so that foreign matter may readily be grasped and removed therefrom through said annular insertion means passageway.

2. A device as in claim 1, further including grasping means, for placement through said annular insertion means passageway and into the hopper, for grasping foreign matter for removal therefrom.

3. A device as in claim 1, wherein said annular insertion means includes a lower portion defining a lower outer diameter for insertion into a hopper opening, an upper portion defining an upper outer diameter larger than said lower outer diameter, and a chamfered outer diameter surface between said lower and upper portion for seating said annular insertion means in a hopper opening.

4. A device as in claim 3, wherein said annular insertion means supports thereon electrical supply means comprising an electrical cord operatively interconnected with said light means.

5. A device as in claim 4, wherein said light means includes at least one light bulb.

6. A device as in claim 3, wherein said upper portion includes an annular lip disposed about said annular insertion means outside diameter.

7. A device as in claim 2, wherein said grasping means includes two relatively long, slender pivotably-attached bars comprising tongs, said bars including opposable teeth for securely grasping foreign matter within said disposal unit.

8. Apparatus for removal of foreign matter from a sink disposal unit of the type having a hopper disposed within said disposal unit for receiving waste material and a flexible splash guard disposed adjacent an opening to said hopper, said apparatus comprising:

(a) a thin-walled annular member having a central passageway, for insertion into said hopper opening so as to provide access to the hopper through said central passageway, said annular member including a lower portion for extending into said hopper opening to displace the flexible splash guard;

(b) a light source supported on said lower portion of said annular member for illuminating the hopper whenever said annular member is inserted into said hopper opening; and (c) grasping means for insertion through said annular member central passageway for grasping and removing foreign matter from said hopper.

9. Apparatus as in claim 8, wherein said annular member has an upper portion having a diameter greater than that of said lower portion, and said annular member further includes a chamfered surface disposed between said upper and lower portions for seating said annular member in a sink opening.

10. Apparatus as in claim 8, wherein said grasping means includes a pair of tongs, including opposable teeth on a grasping end thereof for securely grasping and removing foreign matter from said hopper.

11. Apparatus as in claim 8, wherein said light source includes at least one light bulb.

12. Apparatus as in claim 8, further including:

electrical supply means including an electrical cord associated with said light source for supplying electrical power thereto; and an annular lip disposed about said annular member.

13. A device to aid in removal of foreign matter from a sink disposal unit of the type residing beneath a sink drain opening and having a hopper for receiving waste material and a flexible splash guard disposed within a disposal unit mouth just beneath the sink drain opening, said device comprising:

a thin-walled annular member, having a central passageway, for insertion into said sink opening and said disposal unit mouth for providing access to the hopper through said central passageway thereof, said annular member including an upper portion defining an upper outer diameter larger than the ink opening, a lower portion defining a lower outer diameter smaller than the sink opening for extending into the sink opening and displacing the splash guard, electrical supply means, and a light source, said annular member further including a chamfered surface on the outside diameter thereof and disposed between said upper and lower portions thereof for seating said annular member in the sink drain opening, said light source including at least one light bulb disposed on said lower portion of said annular member for illuminating the hopper, and said electrical supply means including an electrical cord operatively interconnected with said light bulb; and grasping means for insertion through said annular member central passageway, comprising tongs defining two long, slender bars which are pivotably joined, said bars including opposable teeth for securely grasping foreign matter, to facilitate removal of such foreign matter from the hopper.

14. A device as in claim 13, wherein said annular member lower portion has an annular, curved engagement surface for simultaneous contact with the full circumference of, and radially outward deflection of, the sink disposal unit flexible splash guard as said annular member is seated in the sink drain opening.

15. A device as in claim 13, wherein said light source includes another light bulb spaced from said at least one light bulb, for improved illumination of said sink disposal unit hopper.

* * * * *